US009894958B2

(12) United States Patent
Cheney et al.

(10) Patent No.: US 9,894,958 B2
(45) Date of Patent: Feb. 20, 2018

(54) FLEXIBLE ARTICLE OF FOOTWEAR AND RELATED METHOD OF MANUFACTURE

(71) Applicant: Wolverine Outdoors, Inc., Rockford, MI (US)

(72) Inventors: James H. Cheney, Northborough, MA (US); David Thorpe, Acton, MA (US); Alan Lazell, Dongguan (CN)

(73) Assignee: Wolverine Outdoors, Inc., Rockford, MI (US)

( * ) Notice: Subject to any disclaimer, the term of this patent is extended or adjusted under 35 U.S.C. 154(b) by 0 days.

(21) Appl. No.: 14/609,828

(22) Filed: Jan. 30, 2015

(65) Prior Publication Data

US 2016/0219973 A1 Aug. 4, 2016

(51) Int. Cl.

| | |
|---|---|
| ***A43B 13/14*** | (2006.01) |
| ***A43B 9/00*** | (2006.01) |
| ***A43B 13/12*** | (2006.01) |
| ***A43B 13/22*** | (2006.01) |
| ***A43B 13/26*** | (2006.01) |
| ***A43B 13/38*** | (2006.01) |

(52) U.S. Cl.

CPC ..... *A43B 13/141* (2013.01); *A43B 9/00* (2013.01); *A43B 13/12* (2013.01); *A43B 13/223* (2013.01); *A43B 13/26* (2013.01); *A43B 13/38* (2013.01); *A43B 13/383* (2013.01)

(58) Field of Classification Search

CPC ..... A43B 13/141; A43B 13/12; A43B 13/26; A43B 13/223; A43B 13/38; A43B 13/383; A43B 9/00; A43B 13/023; A43B 13/04; A43B 13/125; A43B 13/16; A43B 13/226

USPC ..... 36/102, 30 R, 103, 28, 31, 30 A, 32 R

See application file for complete search history.

(56) References Cited

U.S. PATENT DOCUMENTS

| | | | | |
|---|---|---|---|---|
| 2,207,632 A * | 7/1940 | Meyer | A43B 7/06 36/3 R |
| 2,253,959 A * | 8/1941 | Meyer | A43B 7/1425 36/140 |
| 3,314,092 A | 4/1967 | Pujol | |
| 3,406,468 A | 10/1968 | Pujol | |
| 4,309,832 A | 1/1982 | Hunt | |

(Continued)

FOREIGN PATENT DOCUMENTS

| | | |
|---|---|---|
| EP | 0260777 A2 | 3/1988 |
| EP | 2238848 | 10/2010 |
| GB | 190925198 | 0/1910 |

OTHER PUBLICATIONS

CAT Footwear, Product Photos, 2010.

*Primary Examiner* — Khoa Huynh
*Assistant Examiner* — Griffin Hall

(57) ABSTRACT

An improved article of footwear and a related method of manufacture are provided. The article of footwear can include a sole construction including a midsole and an outsole that are configured to promote the natural motion of the wearer's foot and conformance to the ground. The sole construction can additionally include an insole construction having enhanced flexibility in the forefoot region to further accommodate dorsi-flexion and plantar-flexion of the wearer's foot. The related method of manufacture provides the assembly of an article of footwear having these and other features, which can be suitable for athletic wear, outdoor wear and casual wear by adults, adolescents and small children.

12 Claims, 14 Drawing Sheets

(56) References Cited

U.S. PATENT DOCUMENTS 4,624,061 A * 11/1986 Wezel ..... A43B 5/06 36/102
4,667,423 A * 5/1987 Autry ..... A43B 13/12 36/102
4,676,010 A 6/1987 Cheskin
5,384,973 A 1/1995 Lyden
5,408,761 A 4/1995 Gazzano
5,547,620 A 8/1996 Guiotto
5,806,209 A 9/1998 Crowley et al.
5,983,529 A 11/1999 Sema
6,199,302 B1 3/2001 Kayano
6,205,683 B1 3/2001 Clark et al.
6,338,206 B1 1/2002 Kita
6,393,732 B1 5/2002 Kita
6,412,196 B1 7/2002 Gross
6,544,626 B1 4/2003 Minges
6,601,042 B1 7/2003 Lyden
6,990,755 B2 1/2006 Hatfield et al.
7,101,604 B1 9/2006 Minges
7,290,357 B2 11/2007 McDonald et al.
7,555,851 B2 7/2009 Hazenberg et al.
7,607,241 B2 10/2009 McDonald et al.
7,650,707 B2 * 1/2010 Campbell ..... A43B 3/0057 36/102
7,707,748 B2 * 5/2010 Campbell ..... A43B 5/001 36/102
7,752,775 B2 7/2010 Lyden
8,215,037 B2 7/2012 James
8,303,885 B2 11/2012 Hatfield et al.
8,418,382 B2 4/2013 Madore et al.
8,424,225 B2 4/2013 Hazenberg et al.
8,479,417 B2 7/2013 Flannery et al.
8,656,613 B2 2/2014 Stockbridge et al.
8,834,770 B2 9/2014 Nakano
8,869,435 B2 10/2014 Hatfield et al.
9,241,536 B2 * 1/2016 Smaldone ..... A43B 23/00
2005/0060909 A1 3/2005 Kerns et al.
2006/0143950 A1 * 7/2006 Beak ..... A43B 13/04 36/97
2007/0169379 A1 * 7/2007 Hazenberg ..... A43B 13/125 36/102
2008/0229617 A1 9/2008 Johnson et al.
2012/0055047 A1 * 3/2012 Youngs ..... A43B 13/141 36/25 R
2012/0317844 A1 12/2012 Vattes
2014/0000131 A1 1/2014 Meschter et al.
2014/0150297 A1 * 6/2014 Holmes ..... A43B 13/125 36/103
2014/0250723 A1 * 9/2014 Kohatsu ..... A43B 3/26 36/88
2014/0259744 A1 9/2014 Cooper
2015/0173456 A1 * 6/2015 Rushbrook ..... A43B 13/141 36/25 R
2016/0174656 A1 * 6/2016 Wolfrom ..... A43B 13/122 36/28

* cited by examiner

FLEXIBLE ARTICLE OF FOOTWEAR AND RELATED METHOD OF MANUFACTURE

BACKGROUND OF THE INVENTION

The present invention relates to footwear and, more particularly, to footwear that promotes the natural movement of the wearer's foot and conformity to the ground.

Conventional footwear typically includes two primary elements: an upper and a sole construction. The upper at least partially covers the wearer's foot, and the sole construction provides support for the wearer's sole. The sole construction can include multiple layers and materials. For example, conventional sole constructions can include a molded foam midsole over a natural rubber outsole. The molded foam midsole can provide cushioning while the natural rubber outsole can provide traction and wear resistance.

Conventional sole constructions are primarily flexible in a single direction. In particular, many sole constructions are intended to flex in the upward direction, in which the ground engaging surface of the outsole is convex. Flexibility of this kind is typically achieved with modifications to the outsole. For example, it is known to introduce grooves in the outsole to promote the bending of the outsole in the upward direction. It is also known to separate the outsole into individual components that move away from each other as the outsole is bent in an upward direction.

The natural movement of the wearer's foot is not limited to flexure in the upward direction, however. In addition to upward flexure, or dorsi-flexion, the human foot naturally exhibits downward flexure, or plantar-flexion. Conventional sole constructions typically exhibit significant resistance to plantar-flexion, however. For example, many conventional sole constructions include an outsole or a midsole that resists plantar-flexion of the wearer's foot. By opposing the natural ability of the human foot to flex downwardly, many such sole constructions compromise stability and grip on all but even surfaces.

SUMMARY OF THE INVENTION

An improved article of footwear and a related method of manufacture are provided. The improved article of footwear includes a sole construction configured to promote the natural motion of the wearer's foot over a variety of surfaces and for a variety of activities. The sole construction includes enhanced flexibility in the forefoot region to accommodate planar-flexion and dorsi-flexion of the wearer's foot. The related method of manufacture provides the assembly of an article of footwear having these and other features, which can be suitable for athletic wear, outdoor wear and casual wear by adults, adolescents and small children. The related method of manufacture can be modified to meet the specific demands of the end-use application, thereby providing an article of footwear having the desired degree of cushioning and ground protection while also providing the desired degree of flexibility for the wearer.

In one embodiment, an article of footwear includes an insole element, a midsole, and an outsole. The insole element includes an opening or cutout, optionally including an elastic material spanning the opening or cutout. The opening or cutout extends over flex grooves in the midsole that can define anatomical pods beneath the wearer's forefoot and that promote upward and downward flexibility. The outsole includes a lower surface defining outsole flex grooves in general alignment with the midsole flex grooves. The midsole lower surface and the outsole upper surface define an interface about which the article of footwear can be flexed to accommodate planar-flexion and dorsi-flexion of the wearer's forefoot.

The midsole can include an upper surface defining a plurality of lateral flex grooves and a plurality of longitudinal flex grooves. The plurality of lateral flex grooves include a first lateral flex groove extending generally beneath a junction between the wearer's toe bones and metatarsal bones and a second lateral flex groove extending generally beneath the wearer's metatarsal bones. The plurality of longitudinal grooves intersect the plurality of lateral grooves in the forefoot region of the midsole. The midsole grooves, both longitudinal and lateral, can define a depth that is a percentage of the thickness of the midsole. For example, the midsole flex grooves optionally define a depth between about 25% and 95% of the thickness of the midsole, further optionally between about 70% and 90% of the thickness of the midsole. The midsole flex grooves can alternatively extend entirely through the thickness of the midsole. In other embodiments, the depth of the midsole flex grooves varies, such that the depth of one midsole flex groove is different from the depth of another of the midsole flex groove.

The outsole flex grooves can minor the midsole flex grooves, extending between adjacent tread elements of the outsole. The tread elements are optionally positioned below individual bones, joints and/or muscles and move independently of each other, and are interconnected with each other. For example, individual tread elements are positioned beneath the wearer's toe bones, beneath the wearer's metatarsal bones, beneath the wearer's tarsal bones, and/or beneath the wearer's calcaneus (heel) bone. The tread elements are optionally surrounded by a color dam, which acts as a separation element between the tread elements and the outsole flex grooves. The outsole flex grooves can define a depth that is a percentage of the thickness of the outsole (inclusive of the tread elements). The outsole flex grooves optionally define a depth between about 25% and 95% of the thickness of the outsole, further optionally between about 50% and 70% of the thickness of the outsole. The outsole flex grooves can alternatively extend entirely through the thickness of the outsole.

In another embodiment, a method of manufacturing an article of footwear is provided. The method generally includes lasting an upper with an insole element, forming a midsole including midsole grooves, forming an outsole including outsole grooves, joining the outsole to the midsole, joining the midsole to the insole element, removing an area of material from the forefoot region of the insole element, and positioning a footbed over the insole element. Joining the insole element to the upper can include sewing the insole element to the upper. In embodiments where the insole element is a Strobel board, the insole element can be joined to the upper along a butt seam. In embodiments where the insole element is a lasting board, the insole element can be joined to the upper with cement. Joining the midsole to the insole element can include gluing the midsole to all except the forefoot portion of the insole element. Removing the area of material can include directly or indirectly pulling a perforated segment from the remainder of the insole element. The perforated segment can additionally include a pull tab sewn, cemented or otherwise joined to the perforated portion to aid in the removal of the perforated segment. The remainder of the insole element can include a border around an opening in the forefoot region.

In these and other embodiments, the improved article of footwear can include a sole construction that promotes the natural movement of the foot and ground conformance. The sole construction is generally flexible longitudinally, laterally, and diagonally, accommodating plantar-flexion, dorsi-flexion, and twisting. The sole construction provides a balance of dynamic, multi-directional, barefoot-like movement and conformance with the ground and cushioning with improved surface area contact. The improved surface area contact can enhance stability, proprioception, traction and agility with effective ground protection for a variety of pursuits. Example pursuits include trail running, hiking, hunting, boating, and aquatic activities. Additional applications include footwear specifically adapted to promote walking for infants and small children. The related method of manufacture can be tailored to meet desired levels of flexibility and performance while providing the desired degree of support to the wearer's sole.

These and other advantages and features of the invention will be more fully understood and appreciated by reference to the description of the current embodiments and the drawings.

DESCRIPTION OF THE CURRENT EMBODIMENTS

The current embodiments relate to an improved article of footwear and a related method of manufacture. In these embodiments, the improved article of footwear includes a flexible sole construction adapted to promote the natural motion of the wearer's foot and conformance with the ground, while providing ground protection and support for the wearer. The related method provides the manufacture of an article of footwear having a flexible sole construction for use across a range of activities.

I. Construction

Figure 1:
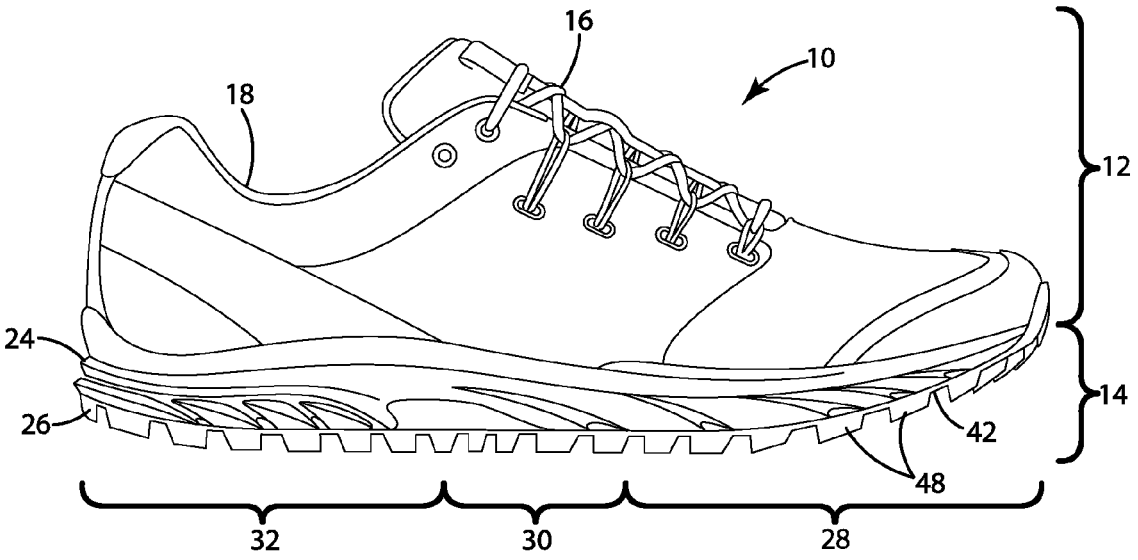
FIG. 1 is an elevation view of an article of footwear in accordance with a current embodiment.

Referring now to FIG. 1, an article of footwear in accordance with one embodiment is illustrated and generally designated 10. The article of footwear 10 includes an upper 12 and a sole construction 14. The upper 12 is formed from a variety of material elements that are joined together to cover at least a portion of the wearer's foot. The material elements can be selected based on the intended uses of the article of footwear 10, and can include synthetic textiles, mesh textiles, polymers or leather, for example. The upper 12 is generally constructed to not impede the flexibility of the sole construction 14, and can include stretchable or elastic material elements. For example, the material elements can include Lycra, Neoprene or Spandex. The upper 12 can include one or more closure elements 16, including for example shoelaces or hook and loop fasteners. The upper 12 additionally includes an upper opening 18 for receiving the wearer's foot and a lower periphery 20 for attachment to the sole construction 14.

The sole construction 14 is also illustrated in side-profile FIG. 1. The sole construction 14 is adapted to provide flexibility for a range of foot movements, including for example plantar-flexion and dorsi-flexion. The sole construction 14 includes an insole element 22 (not shown in FIG. 1), a midsole 24 and an outsole 26, but greater or fewer elements of the sole construction 14 can be included in other embodiments. For example, some embodiments can include only a midsole an outsole, while other embodiments can include only an insole element and an outsole. Still other embodiments can include a unit sole, in which the midsole and the outsole are combined into a single unitary element. The unit sole can include EVA foam with a cushioning top portion and a firmer, wear resistant bottom portion. Each of the insole element 22, the midsole 24 and the outsole 26 can additionally include a forefoot region 28, a mid-foot or arch region 30, and a rearfoot region 32.

Figure 2:
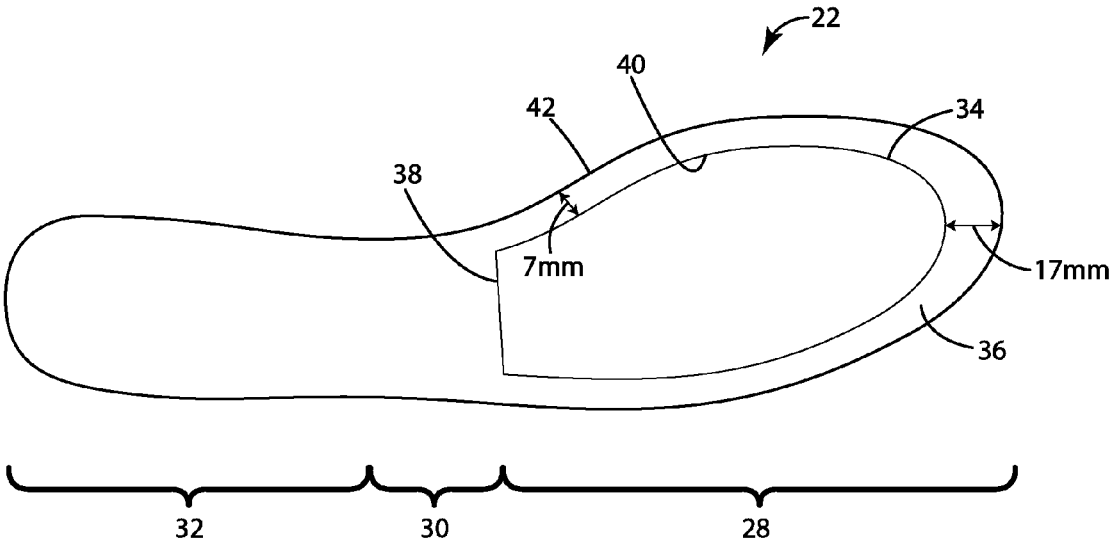
FIG. 2 is a plan view of a first insole element for the article of footwear of FIG. 1.

An insole element 22 in accordance with one embodiment is illustrated in FIG. 2. The insole element 22 is generally non-stretchable and lightweight and joined to the upper 12 to provide a void for receipt of the wearer's foot. The insole element 22 includes enhanced flexibility in at least the forefoot region 28 in the illustrated embodiment, and can include increased flexibility in the mid-foot region 30 and rearfoot region 32 in other embodiments. The enhanced flexibility is optionally achieved with an interior opening 34 extending entirely through the thickness of the insole element 22. The interior opening 34 generally overlies one or more flex grooves in the midsole 24 as discussed below. In addition, the interior opening 34 is enclosed by a peripheral lip 36. The peripheral lip 36 is generally flat, includes a generally uniform width, and is joined to the upper 12, optionally along a butt seam. The insole element 22 includes a Strobel board in the current embodiment, while in other embodiments the insole element 22 includes a lasting board. The insole element 22 can be non-woven, woven or fibrous, and can be formed of nylon, polyester, or polypropylene. Still other constructions for the insole element 22 are possible in other embodiments where desired.

The outline of the interior opening 34 generally mimics the shape of the forefoot region of the insole element 22. In particular, the outline of the interior opening 34 generally includes a straight portion 38 adjacent the mid-foot region 30 of the insole element 22 and a curved portion 40 forward of the straight segment 38. The curved portion 40 is spaced apart from the outer periphery 42 of the insole element 22 by 7 mm to 17 mm in the present embodiment, but can be spaced apart by other distances in other embodiments. For example, the spacing can be between 5 mm and 25 mm, further optionally between 10 mm and 15 mm.

Figure 3:
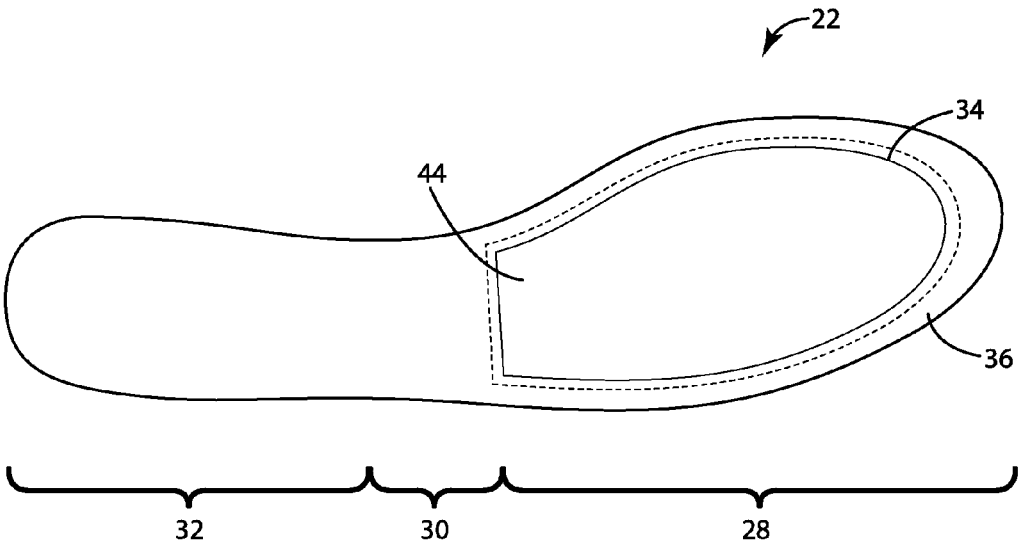
FIG. 3 is a plan view of a second insole element for the article of footwear of FIG. 1.
Figure 4:
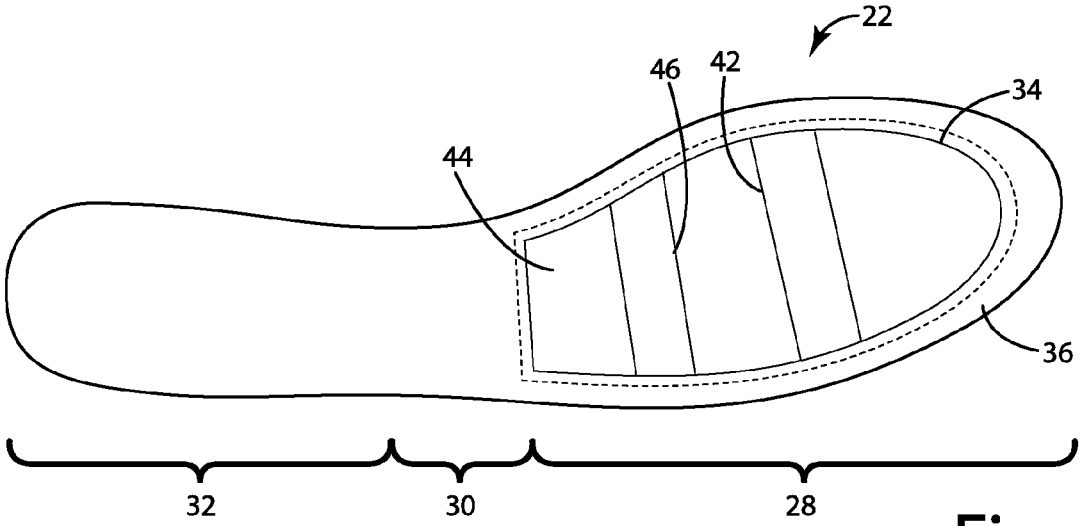
FIG. 4 is a plan view of a third insole element for the article of footwear of FIG. 1 with non-stretch webbing.
Figure 20:
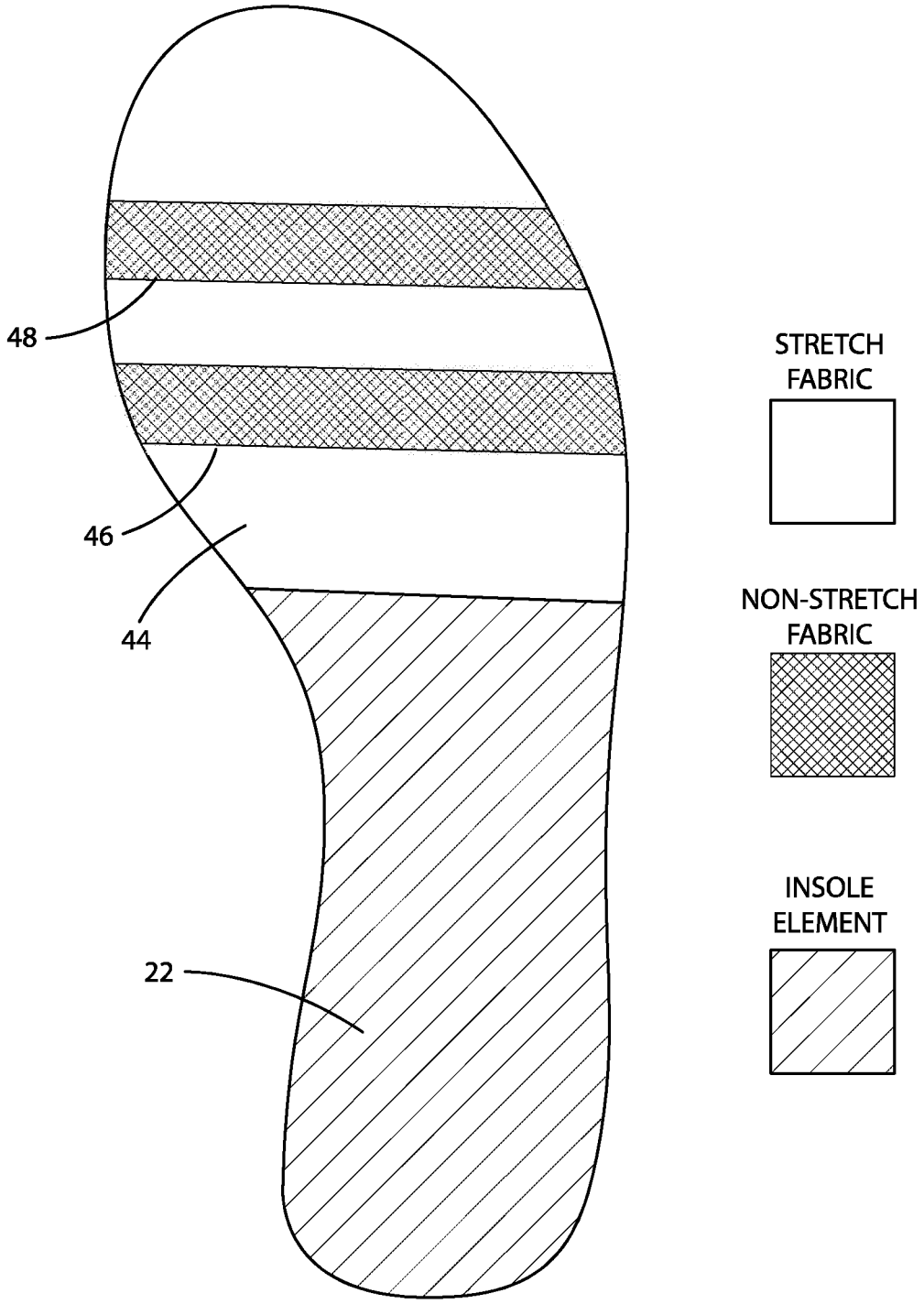
FIG. 20 is a plan view of the underside of an insole element including non-stretch webbing extending across the forefoot region and joined to the upper.

The interior opening 34 can be modified as desired. As further optionally shown in FIG. 3, for example, a flexible, stretchable covering 44 can extend over the opening 34 in the insole element 22. The flexible, stretchable covering 44 can include an elastic membrane that extends partially or completely over the opening 34 in the forefoot region 28 of the insole element 22, being generally secured to the downward facing surface of the insole element 22. The elastic membrane includes Lycra, Neoprene or Spandex in the illustrated embodiment, while in other embodiments other materials can be used as desired. The opening 34 can additionally include one or more web stiffeners. As shown in FIG. 4, two web stiffeners 46, 48 are arranged to extend across the opening 34, thereby providing an added degree of dimensional stability to the flexible covering 44. In the illustrated embodiment, the web stiffeners 46, 48 are formed separately from the insole element 22 and are glued, stitched or stapled thereto prior to the formation of the opening 34 in the insole element 22. In other embodiments the web stiffeners 46, 48 are formed of the same material as the insole element 22, and separate the opening 34 into sub-openings. In still other embodiments, the interior opening is replaced by one or more web stiffeners 46, 48 that are joined to the upper 12 and that span the forefoot region. As shown in FIG. 20 for example, the web stiffeners 46, 48 are joined to the lower periphery of the upper 12, optionally by means of a butt seam, on the upward facing surface of the insole element 22. An optional flexible covering 44 can extend across the remainder of the open area in the forefoot region, and can be Lycra, Neoprene or Spandex as generally discussed above in connection with FIGS. 3-4. The web stiffeners 46, 48 are generally cut or removed once the article of footwear is assembled as discussed below to enhance flexibility of the finished construction.

Figure 5:
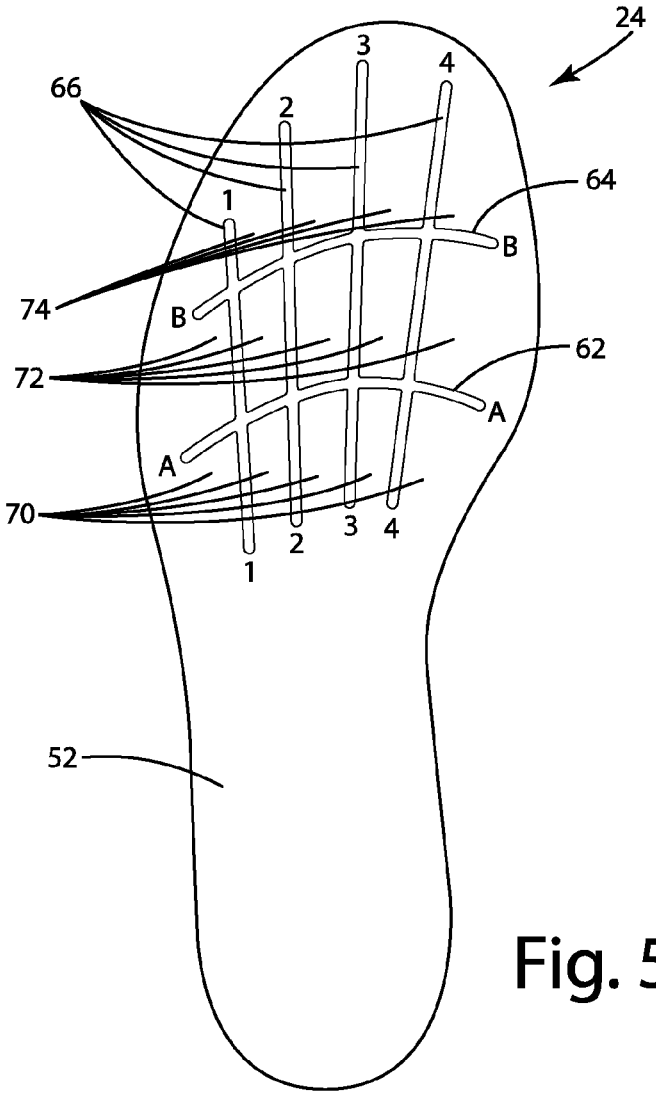
FIG. 5 is a plan view of a first midsole for the article of footwear of FIG. 1 including flex grooves and anatomical pods.

A midsole 24 in accordance with one embodiment is illustrated in FIG. 5. The midsole 24 is positioned below the insole element 22, and includes a lower surface 50, an upper surface 52, and a sidewall 54 extending therebetween. The upper surface 52 can include multiple midsole grooves 60. The midsole grooves 60 are positioned to provide enhanced bending flexibility to the midsole, and in particular, bending flexibility in the downward (plantar-flexion) direction. The midsole grooves 60 generally underlie the insole opening 34, providing enhanced flexibility in the forefoot region 28. In addition, the midsole grooves 60 are contained within the midsole upper surface 52. In other embodiments, the midsole grooves 60 are contained within the midsole lower surface 50. In still other embodiments, both of the lower surface 50 and the upper surface 52 include midsole grooves 60. In yet other embodiments, the midsole grooves 60 extend to the edge of the midsole 24 and define a break in the midsole sidewall 54.

The midsole grooves 60 can assume a variety of configurations. In the illustrated embodiment of FIG. 5, the midsole grooves 60 include a depth that extends partially through the thickness of the midsole 24, such that the midsole grooves 60 are not in communication with the outsole 26. For example, the midsole 24 can include a local thickness of about 11 mm and the midsole grooves 60 can include a depth of about 9 mm, leaving a connecting portion of about 2 mm. These dimensions can vary in other embodiments as desired. In dimensionless terms, the midsole grooves 60 can define a depth between about 25% and 95% of the thickness of the midsole 24, further optionally between about 70% and 90% of the thickness of the midsole 24. In other embodiments the midsole grooves 60 include a depth that extends entirely through the thickness of the midsole 24, such that the midsole grooves 60 are in communication with the outsole 26. The midsole grooves 60 can include a width (gap) that is selected to provide the desired degree of flexibility for the sole construction. For example, the width can be 1 mm in embodiments where modest flexibility is desired, and 3 mm in embodiments where greater flexibility is desired.

Figure 6:
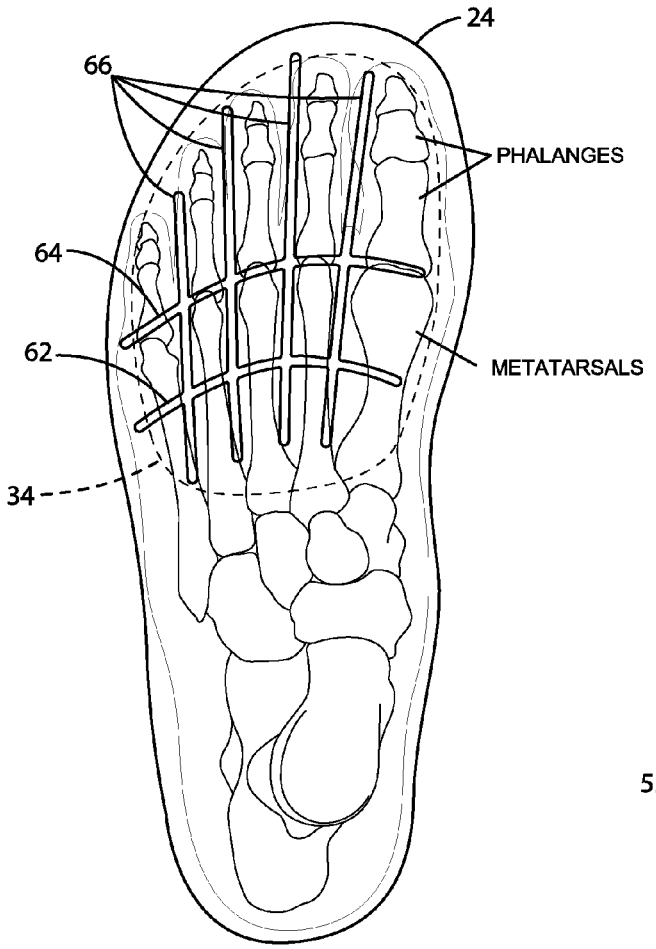
FIG. 6 is a plan view of the midsole of FIG. 5 having a superimposed bone structure for the human foot.

Referring again to FIG. 5, the midsole grooves 60 include multiple lateral grooves and multiple longitudinal grooves. The lateral grooves include a first lateral groove 62 and a second lateral groove 64. The first lateral groove 62 is positioned to extend generally beneath the wearer's toes and forefoot. The second lateral groove 64 is spaced apart from the first lateral groove 62 in the longitudinal (heel-to-toe) direction. As shown in FIG. 6 for example, the second lateral groove 64 is positioned to extend generally beneath and between a junction between the wearer's phalanges (toe bones) and metatarsals. As also shown in FIG. 6, the first and second lateral grooves 62, 64 are arcuate in the present embodiment, but can be straight, angled or segmented in other embodiments. The longitudinal grooves 66 extend in the heel-to-toe direction, and intersect the first and second lateral grooves 62, 64. The longitudinal grooves 66 are positioned generally beneath and between adjacent metatarsals/toes, and facilitate torsional and longitudinal bending of the midsole 24. While shown as being located in the forefoot region of the midsole in the present embodiment, the midsole grooves 60 can extend into the mid-foot region 30 and/or the rearfoot region 32 of the midsole in other embodiments.

The midsole grooves 60 can define anatomical pods 68 that are shaped to generally correspond with one or more anatomical features of the human foot. As shown in FIG. 5, for example, each anatomical pod 68 is bordered on two, three or four sides by the midsole grooves 60. A first row of anatomical pods 70 is bordered by the first lateral groove 62 and by the longitudinal grooves 66. A second row of anatomical pods 72 is bordered by the first and second lateral grooves 62, 64 and by the longitudinal grooves 66. A third row of anatomical pods 74 is bordered by the second lateral groove 64 and by the longitudinal grooves 66. In addition, each anatomical pod 68 underlies one or more bones in the wearer's foot. The first and second rows of anatomical pods 70, 72 generally underlie the metatarsals, while the third row of anatomical pods 74 generally underlies the phalanges. The pods 68 can assume other anatomical or non-anatomical shapes or locations in other embodiments as desired.

The midsole grooves 60 can deform to accommodate movement of the wearer's foot. For example, the gap within each midsole groove 60 can widen or narrow depending on the curvature imposed on the midsole 24 and the predominate direction of the midsole groove 60. If the midsole groove 60 is predominately laterally disposed (e.g., grooves 62 and 64), the midsole groove 60 can widen as the midsole 24 is flexed upwardly or narrow as the midsole 24 is flexed downwardly. If the midsole groove 60 is longitudinally disposed (e.g., grooves 66), the midsole groove 60 can widen as the midsole 24 assumes a longitudinally convex curvature and can narrow as the midsole 24 assumes a longitudinally concave curvature. The presence of the lateral midsole grooves 62, 64 therefore assist in promoting the natural movement of the human foot, and conformance to the ground, beyond that which is accommodated by conventional footwear constructions.

Figure 7:
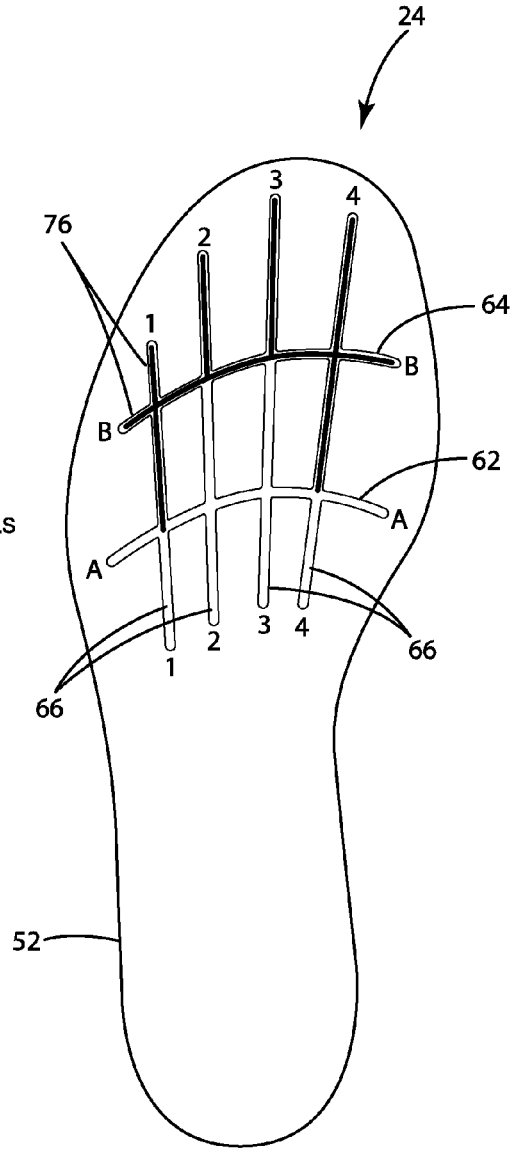
FIG. 7 is a plan view of a second midsole for the article of footwear of FIG. 1 including flex grooves and anatomical pods.
Figure 8:
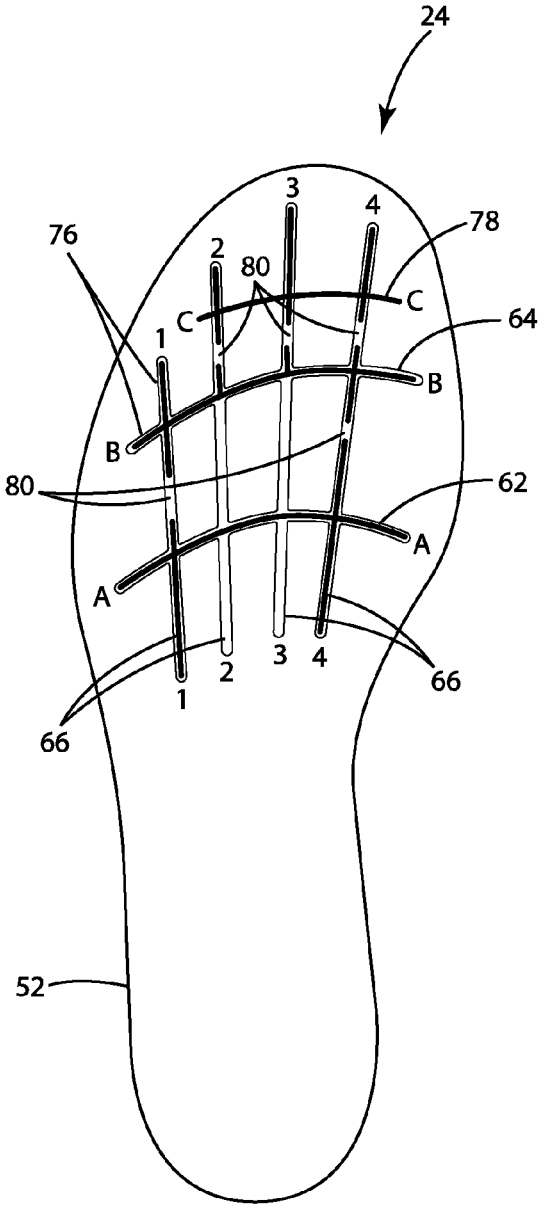
FIG. 8 is a plan view of a third midsole for the article of footwear of FIG. 1 including flex grooves and anatomical pods.

The midsole grooves 60 can assume a variety of alternative configurations. For example, the midsole grooves 60 can include a depth that extends entirely through the thickness of the midsole 24, such that the midsole grooves 60 are in communication with the outsole 26, enhancing the flexibility of the outsole 26. In other words, the midsole grooves 60 define slots 76 that perforate the entire thickness of the midsole. As shown in FIG. 7, the slots 76 (the shaded portions of the grooves 60) can penetrate the second lateral groove 64 and the longitudinal grooves 66 at selective locations along the length of the longitudinal grooves 66. As shown in FIG. 8, the slots 76 can penetrate the first and second lateral grooves 62, 64, the outermost longitudinal grooves 66, and the innermost longitudinal grooves 66 at selective locations along their length. An optional third lateral groove 78 extends forward of the second lateral groove 64. Individual connectors 80 join adjacent anatomical pods 68 that would otherwise be disconnected from the remainder of the midsole 24. The outsole 26 is generally viewable through the slots 76 (around the connectors 80) in these embodiments, optionally extending upwardly into the slots 76. The connectors 80 can be severed or removed during the manufacture of the article of footwear, for example after joining the outsole 26 to the midsole 24. The connectors 80 can also be suspended above the outsole 26. That is, the midsole grooves 60 can define a relief in the upper surface of the midsole 24 and can define a matching relief in the lower surface of the midsole 24. For example, the midsole 24 can have a thickness of 8 mm, an upper midsole groove having a 3 mm depth, and a lower midsole groove having a 3 mm depth, leaving a connector 80 having a thickness of 2 mm (in the vertical dimension) that is suspended above the outsole 26. Different configurations can be utilized in other embodiments where desired.

Figure 9:
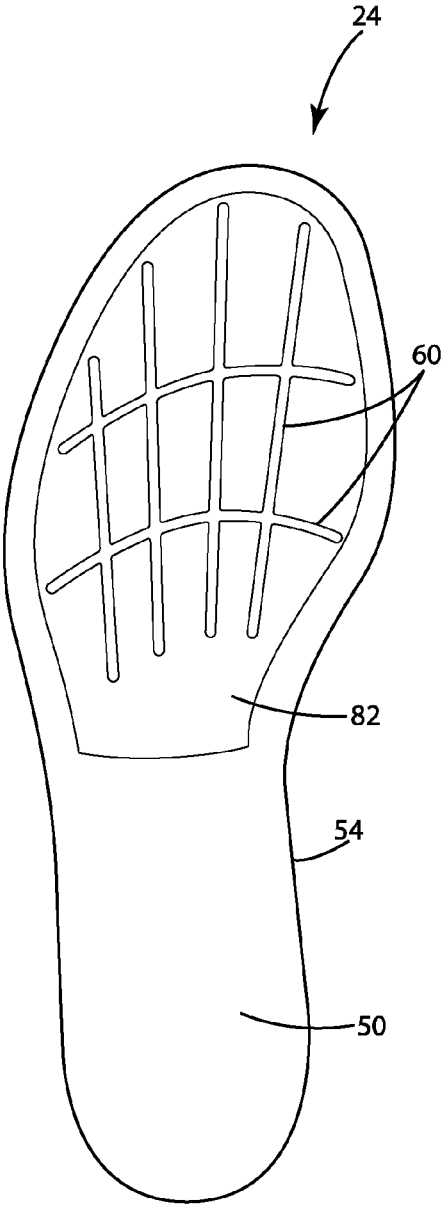
FIG. 9 is a plan view of the underside of a midsole illustrating a protective film in the forefoot region of the midsole.
Figure 10:
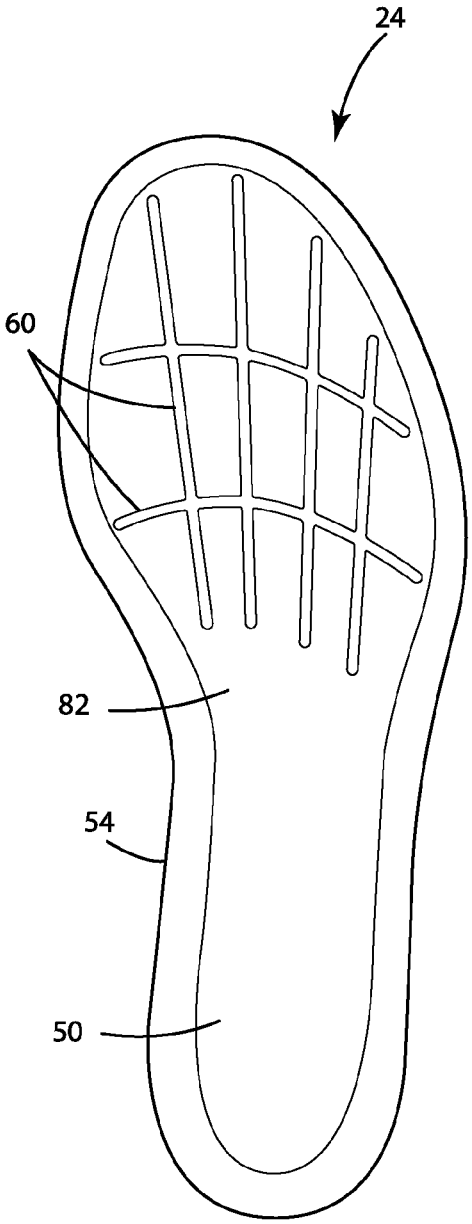
FIG. 10 is a plan view of the underside of a midsole illustrating a protective film in the forefoot, mid-foot, and rearfoot regions of the midsole.
Figure 11:
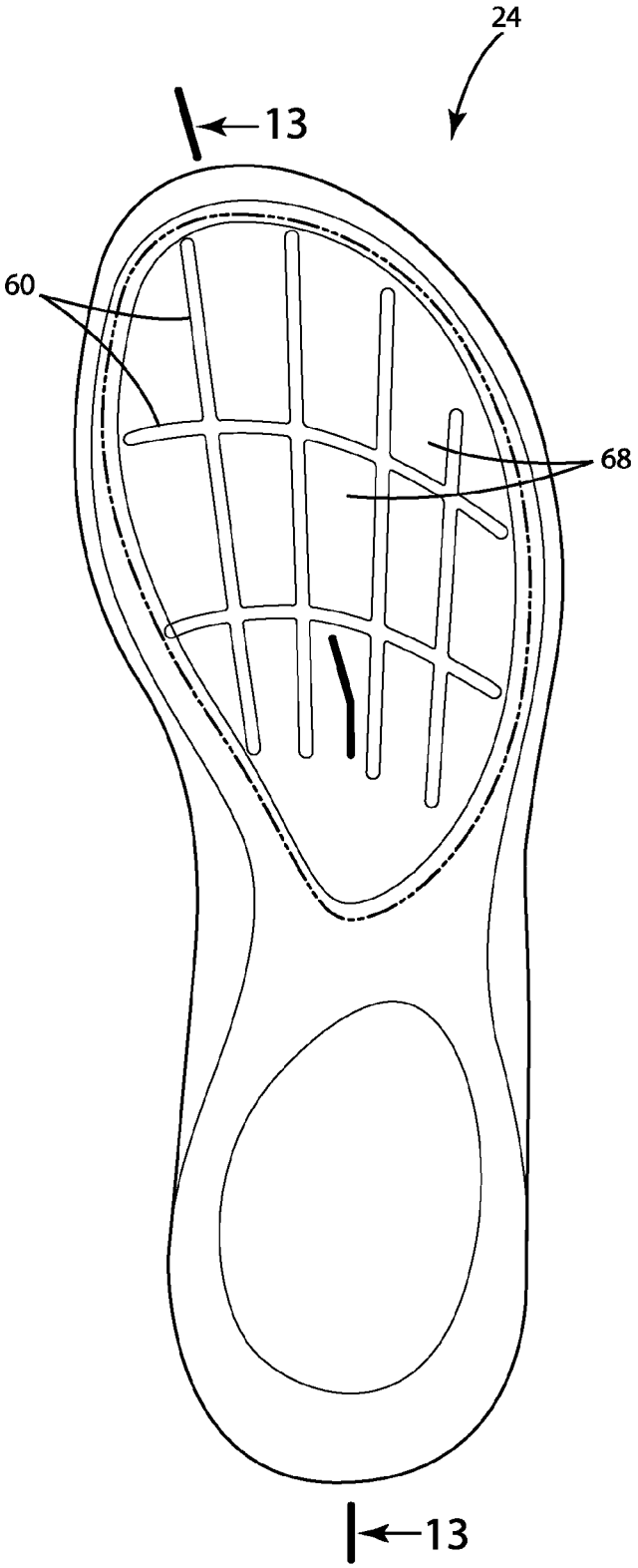
FIG. 11 is a plan view of the upper surface of a midsole in accordance with a current embodiment.

The midsole 24 can include essentially any material suitable for providing foot support. For example, the midsole 24 can include ethylene-vinyl acetate, polyurethane, or thermoplastic elastomer. The midsole 24 can be compression molded in some embodiments, while in other embodiments the midsole 24 can be injection molded. Other manufacturing techniques can be used in other embodiments as desired. The midsole 24 can additionally include a protective film 82 (also referred to as a protective plate 82) that extends over the upper surface 52, the lower surface 50, or both the upper surface 52 and the lower surface 50 of the midsole 24. As shown in FIG. 9, for example, a 1 mm protective film 82 extends over the lower surface 50 of the forefoot region 28 of the midsole 24. As shown in FIG. 10, the protective film 82 extends over substantially the entire lower surface 50 of the midsole 24. The protective film 52 optionally includes ethylene-vinyl acetate plastic, thermoplastic polyurethane, or Pebax® (polyether block amide, available from Arkema), which can provide enhanced strength to the midsole 24 without degrading the flexibility of the midsole 24. The midsole 24 can additionally be formed of two or more materials having different material properties. For example, the midsole 24 can include a first material in a first one of the anatomical plurality pods 68 and a second material in a second one of the plurality of anatomical pods 68. Further by example, the midsole 24 can include a first material in the forefoot region and a second material in the rearfoot or mid-foot region.

Figure 12:
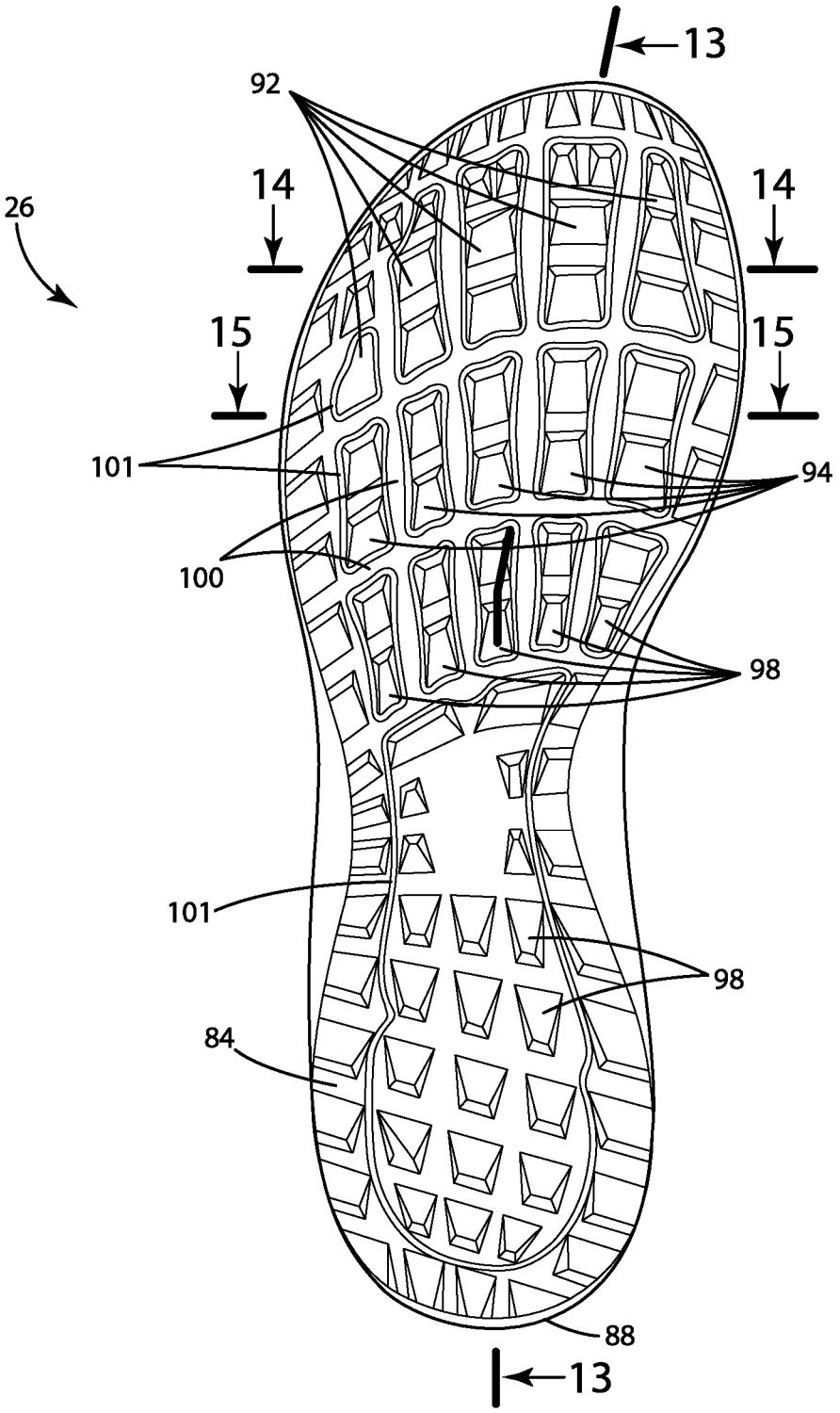
FIG. 12 is a plan view of the lower surface of an outsole in accordance with the embodiment of FIG. 11.
Figure 16:
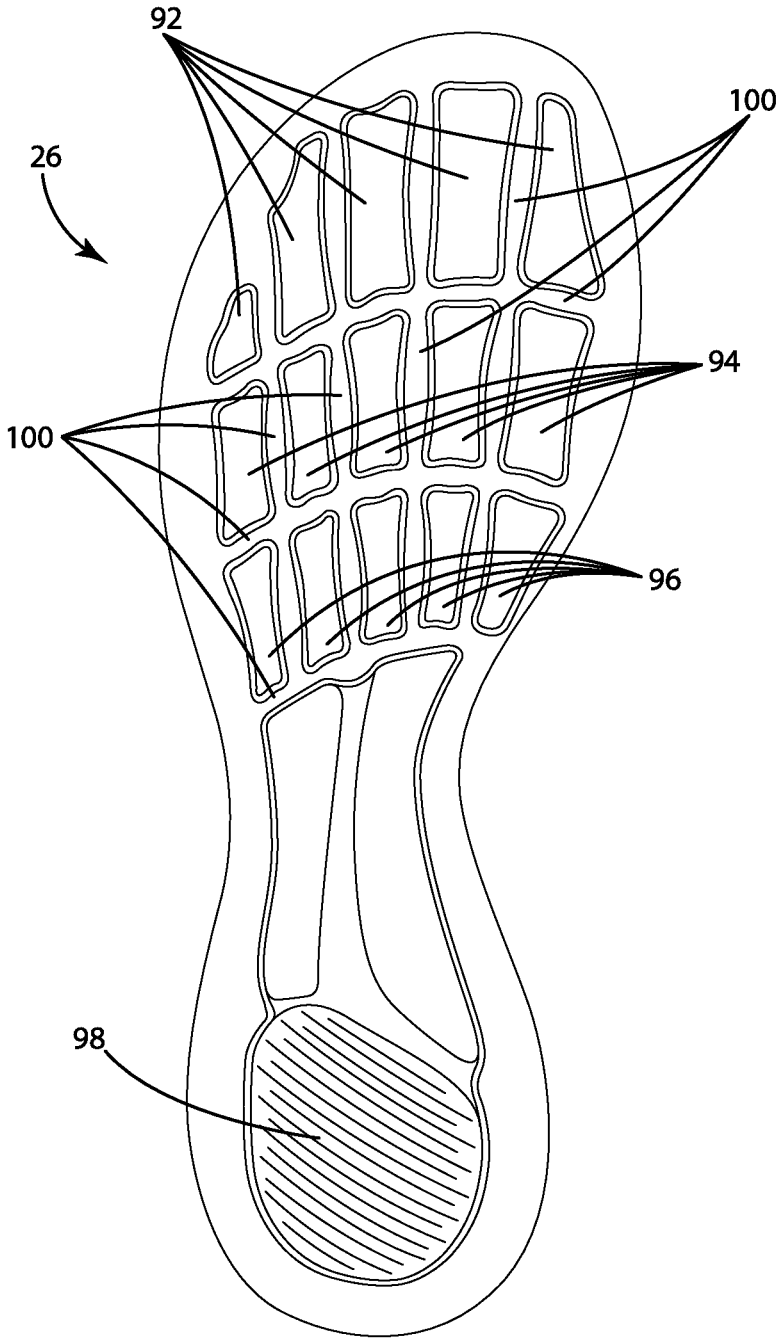
FIG. 16 is a plan view of an outsole in accordance with a current embodiment illustrating anatomical tread elements.

An outsole 26 in accordance with one embodiment is illustrated in FIG. 12. The outsole 26 includes a lower surface 84, an upper surface 86, and a sidewall 88 extending therebetween. The lower surface 84 additionally includes one or more tread elements 90 (shown in FIGS. 12 as 92, 94, and 96). The tread elements 90 optionally include a two-dimensional shape that corresponds to one or more anatomical features of the human foot. For example, the tread elements 90 can include a two-dimensional shape (in plan view) that corresponds to the following anatomical features: the phalanges, the metatarsal bones, the tarsal bones, the arch, and/or the calcaneus (heel) bone. As optionally shown in FIGS. 12 and 16, the tread elements 90 include a first row of five tread elements 92 beneath the wearer's toes, a second row of five tread elements 94 beneath the wearer's metatarsals, and a third row of five tread elements 96 beneath the wearer's metatarsals. Additional tread elements 98 can extend below the wearer's heel and arch. The tread elements 90 can assume other anatomical features or non-anatomical features in other embodiments as desired, and can be textured or smooth.

The outsole 26 can additionally include one or more outsole grooves 100. The outsole grooves 100 generally include an upwardly recessed portion (relative to the lowermost extend of the tread elements 90) between adjacent tread elements 90. In other embodiments the outsole grooves 100 include downwardly recessed grooves in the upper surface 86 of the outsole 26. The outsole grooves 100 can be linear, curved, angled, segmented, circular, or polygonal. As shown in FIG. 12, the outsole grooves 100 are positioned between adjacent tread elements 90, and are aligned with the midsole grooves 60 discussed above, including both longitudinal and lateral outsole grooves. Each outsole groove 100 includes a length, a width, and a depth. The depth can extend partially through the thickness of the outsole 26, such that the outsole grooves 100 are not in communication with the midsole 24. For example, the outsole 26 can include a thickness of approximately 6 mm (including the tread elements 90), and the outsole grooves 50 can define a depth of approximately 4 mm (leaving a 4 mm tread element and a 2 mm base layer). Still further by example, the outsole 26 can include a thickness of approximately 6 mm (including the tread elements), and the outsole grooves 50 can define a depth of approximately 3 mm (leaving a 3 mm tread element and a 3 mm base layer). In dimensionless terms, the outsole grooves 100 can define a depth between about 25% and 95% of the overall thickness of the outsole 26, further optionally between about 50% and 70% of the overall thickness of the outsole 26. In other embodiments, the outsole grooves 100 include a depth that extends entirely through to the outsole 26, such that the outsole grooves are in communication with the midsole 24. The outsole 26 can additionally include color dams 101. As shown in FIG. 12, for example, the color dams 101 extend around the tread elements 90 and separate the tread elements 90 from the adjacent outsole grooves 100. In other embodiments color dams 101 are not included, and the outsole grooves 100 abut the tread elements 90.

The width of each outsole groove 100 can deform to accommodate movement of the wearer's foot. In particular, the width of each outsole groove 100 can widen or narrow based on the curvature imposed on the outsole 26 and based on the predominate direction of the outsole groove 100. If the outsole groove 100 is laterally disposed on the lower surface of the outsole 26, the width can widen/stretch as the outsole 26 is flexed upwardly and can narrow/compress as the outsole 26 is flexed downwardly. If the outsole groove 50 is longitudinally disposed on the lower surface of the outsole 26, the width can widen/stretch as the outsole 26 assumes a longitudinally convex curvature and can narrow/compress as the outsole 26 assumes a longitudinally concave curvature.

The outsole 26 can include essentially any material suitable for providing a durable wear surface. For example, the outsole 26 can include natural or synthetic rubber. Also by example, the outsole 26 can include thermoplastic polyurethane, thermoplastic rubber or high density ethylene-vinyl acetate foam. The outsole 26 is a unitary component in the present embodiment, but can be formed of separately molded components in other embodiments. The outsole 26 can be compression molded in some embodiments, while in other embodiments the outsole can be injection molded. Other manufacturing techniques can be used in other embodiments as desired. The outsole 26 can additionally include a protective film 82 that extends over either or both of the upper surface 86 and the lower surface 84 of the outsole 26. The protective film 82 can includes insert molded ethylene-vinyl acetate plastic, which can provide enhanced resistance to wear and ground protection without limiting the flexibility of the outsole 26.

Various modifications of the outsole 26 are possible. For example, the midsole grooves 60 and the outsole grooves 100 can be offset with respect to each other. In addition, the lower surface 50 of the midsole 24 and the upper surface 86 of the outsole 26 can include interengaging portions that ensure the appropriate alignment of the midsole 24 with respect to the outsole 26. For example, the outsole 26 can include a raised upper surface portion 102 overlying each outsole groove 100, while the midsole 24 can include a recessed lower surface portion 104 underlying each midsole groove 60. The protective film 82 can extend across the sole construction 14, generally undulating between the midsole 24 and the outsole 26. The tread elements 90 project downwardly from the lower surface 84 of the outsole 26 and adjacent to the outsole grooves 100 as discussed above in connection with FIG. 12.

Figure 13:
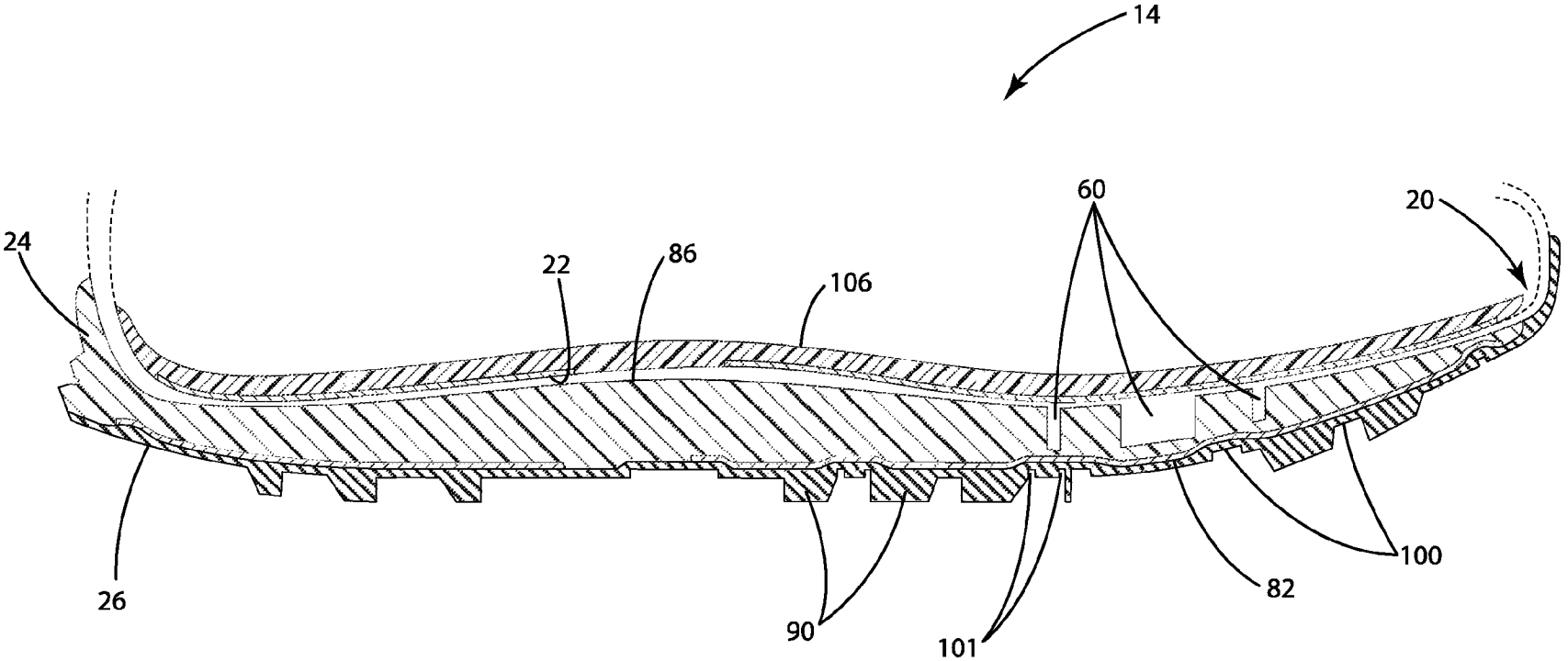
FIG. 13 is a cross-sectional view of the midsole of FIG. 11 and the outsole of FIG. 12 taken along line 13-13 in FIGS. 11-12.
Figure 14:
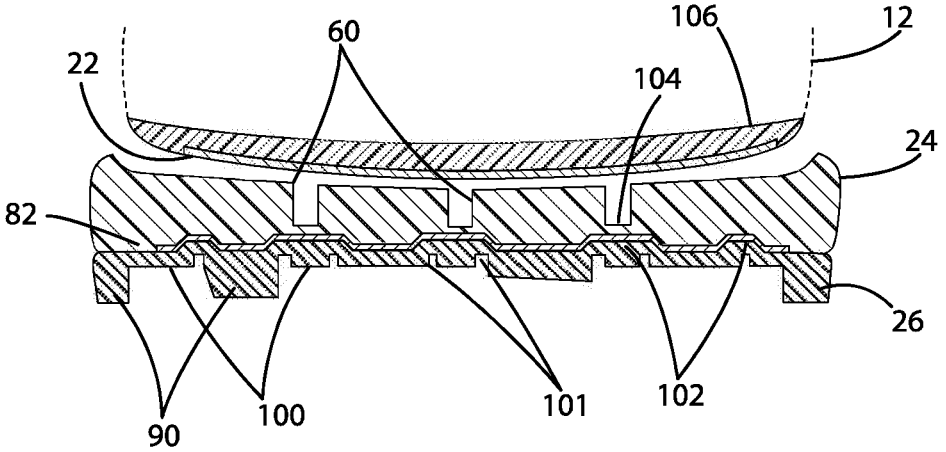
FIG. 14 is a second cross-sectional view of the midsole of FIG. 11 and the outsole of FIG. 12 taken along line 14-14 in FIGS. 11-12.
Figure 15:
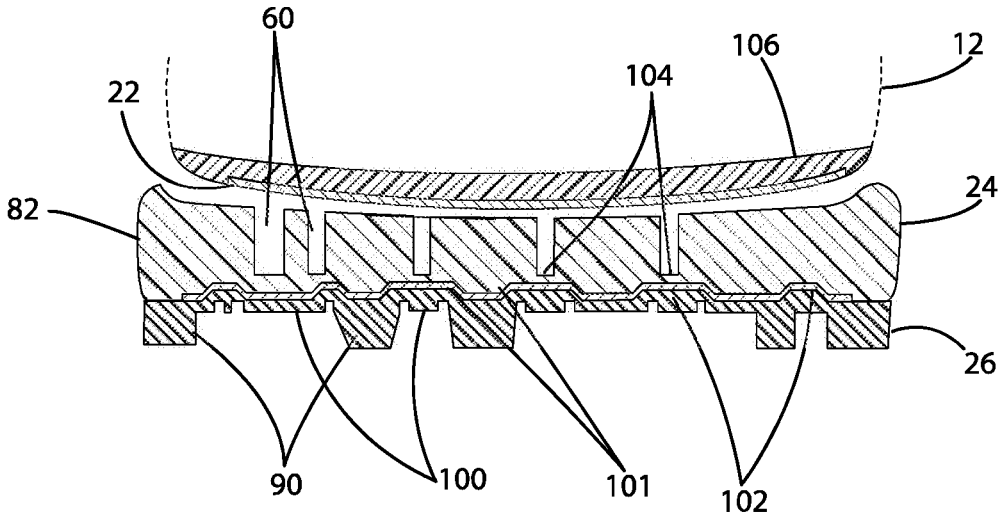
FIG. 15 is a third cross-sectional view of the midsole of FIG. 11 and the outsole of FIG. 12 taken along line 15-15 in FIGS. 11-12.

As also shown in FIGS. 13-15, the article of footwear 10 can include a footbed 106. The footbed 106 can include a molded foam element having a size and a shape adapted to support at least a portion of the wearer's foot. In addition, the footbed 106 can generally compliment the flexibility of the insole element 22, the midsole 24, and the outsole 26, without restricting the same. In some embodiments the footbed 106 can generally surround the forefoot of the wearer, the arch of the wearer, and the heel of the wearer. In other embodiments the footbed 106 does not surround the forefoot of the wearer, and is generally limited to the rearfoot portion of the insole element 22. The footbed 106 is removable in some embodiments, while in other embodiments the footbed 106 is bonded to the insole element 22, the midsole 24, or both the insole element 22 and the midsole 24, while being generally free from attachment in the forefoot region. The footbed 102 can be formed of essentially any lightweight material, including for example foam latex, ethylene-vinyl acetate, thermoplastic elastomer, or polyurethane. The footbed 106 can additionally include flex grooves substantially as set forth above in connection with the midsole flex grooves 60 of FIGS. 5-11, and can include a protective film substantially as set forth above in connection with FIGS. 9-10.

II. Method of Manufacture

Figure 17:
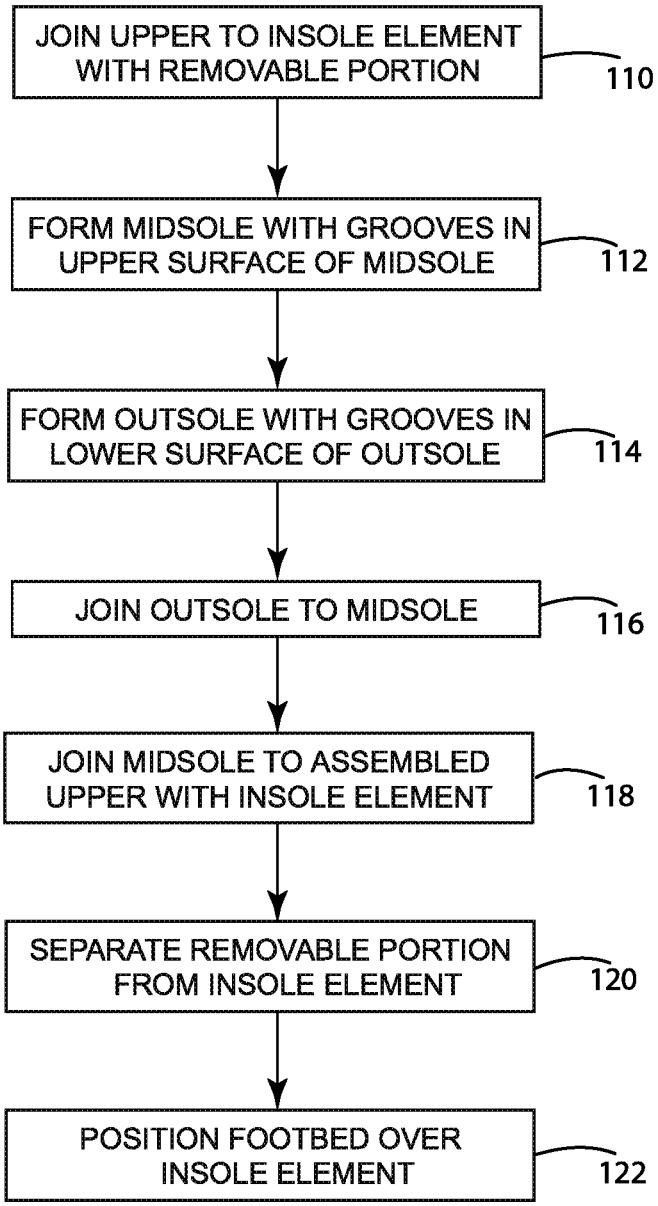
FIG. 17 is a flow-chart illustrating a method for manufacturing an article of footwear in accordance with an embodiment of the present invention.

Referring now to FIG. 17, a flow chart illustrating a method for forming an article of footwear including a flexible sole construction is provided. In general terms, the method according to one embodiment includes: a) joining an insole element to an upper, the insole element having a removable portion; b) forming a midsole including a midsole groove in an upper surface thereof; c) forming an outsole including an outsole groove in a lower surface thereof; d) joining the outsole to the midsole; e) joining the midsole to the upper or the insole element; f) separating the removable portion from the insole element to define an opening in the insole element; and g) positioning a footbed over the insole element.

Joining an insole element to an upper is depicted as step 110 in FIG. 17. This step can include stitching, tacking, or gluing an insole element 22 to an upper 12, optionally while the upper 12 is drawn over a last. For example, this step can include sewing an insole element 22 to an upper 12 along a butt seam, the butt seam extending around the entire periphery of the insole element 22. When joined together, the insole element 22 and the upper 12 provide a void for receipt of the wearer's foot. The insole element 22 and the upper 12 can be formed according to any desired method and can include any desired material. For example, the insole element 22 can include a Strobel board or a lasting board, can be non-woven, woven or fibrous, and can be formed of nylon, polyester, or polypropylene. Also by example, the upper 12 can include multiple elements that are joined together, and can include synthetic textiles, mesh textiles, polymers or leather.

Forming a midsole including a midsole groove is depicted as step 112 in FIG. 17. This step generally includes molding a material into the shape of the midsole 24, the material being pliable or flexible. Optional materials include ethylenevinyl acetate, polyurethane, or thermoplastic elastomer. Other materials can be used in other embodiments where desired. The midsole 24 can be formed by compression molding the midsole in a cavity having the desired exterior shape of the finished midsole or by injection molding the midsole in a cavity having the desired exterior shape of the finished midsole. The finished midsole can generally include a plurality of midsole grooves 60 on an upper surface thereof to improve the flexibility of the midsole. The plurality of midsole grooves 60 are substantially as set forth above in connection with FIGS. 5-11, and can include lateral grooves 62, 64 and longitudinal grooves 66. The midsole grooves 60 define a depth less than the thickness of the midsole 24, such that the midsole grooves 60 do not extend entirely through to the bottom of the midsole 24. In other embodiments, however, and as shown in FIGS. 7-8, the midsole grooves 60 includes slots 76 extending entirely through to the bottom of the midsole 24. While located in the forefoot region of the midsole in the present embodiment, the midsole grooves 60 can extend into the mid-foot region 30 and/or the rearfoot region 32 in other embodiments.

The step of forming the midsole 24 can additionally include forming a protective film 82 on the midsole 24. The protective film 82 can extend over all or a portion of the lower surface 50 of the midsole 24 in some embodiments, and can extend over all or a portion of the upper surface 52 of the midsole 24 in other embodiments. For example, the protective film 82 can extend over a substantial portion of the forefoot region 28 as shown in FIG. 9, and can extend over the rearfoot, mid-foot and forefoot regions of the midsole 24 as shown in FIG. 10. The protective film 82 can include essentially any protective coating. In the present embodiment, the protective film 82 includes an insert molded ethylenevinyl acetate plastic, thermoplastic polyurethane, or Pebax® (polyether block amide, available from Arkema). The protective film 82 can include other materials in other embodiments where desired.

Forming an outsole including an outsole groove is depicted as step 114 in FIG. 17. This step generally includes molding a material into the shape of the outsole 26, the material being wear resistant. Optional materials include natural or synthetic rubber, thermoplastic rubber, or high density ethylene-vinyl acetate. Other materials can be used in other embodiments where desired. The outsole 26 can be formed by compression molding the outsole 26 in a cavity having the desired exterior shape of the finished outsole or by injection molding the outsole 26 in a cavity having the desired exterior shape of the finished outsole. As discussed above in connection with FIGS. 12-16, the outsole 26 can include a plurality of outsole grooves 100 to improve the flexibility of the outsole 26. For example, the plurality of outsole grooves 50 can extend around one or more tread elements 90. In the illustrated embodiment, the outsole grooves 100 define a depth less than the thickness of the outsole 26, such that the outsole grooves 100 do not extend entirely through to the top of the outsole 26. In other embodiments, however, the outsole grooves 100 include slots extending entirely through to the top of the outsole 26. The outsole grooves 100 are located in the forefoot region 28 in the illustrated embodiment, but can extend into the mid-foot region 30 and/or the rearfoot region 32 in other embodiments. In still other embodiments, additional outsole grooves 100 extend downwardly from the upper surface of the outsole 26 in the forefoot region 28, mid-foot region 30 and/or rearfoot region 32. As discussed above in connection with the midsole 24, the outsole grooves 100 can be in vertical alignment with each other, such that a thin outsole connector is suspended between the outsole grooves 100, thereby providing enhanced flexibility to the outsole 26.

The step of forming the outsole 26 can additionally include forming a protective film 82 on the outsole 26. The protective film 82 can extend over all or a portion of the upper surface 86 of the outsole 26 in some embodiments, and can extend over all or a portion of the lower surface 84 of the outsole 26 in other embodiments. The protective film 82 can include essentially any protective coating for the outsole 26. In the present embodiment, the protective film 82 includes ethylenevinyl acetate plastic. The protective film 82 can include other materials in other embodiments where desired.

The step of joining the outsole to the midsole is depicted as step 116 in FIG. 17. This step generally includes applying adhesive or cement, or otherwise bonding the outsole upper surface 86 to the midsole lower surface 50. For example, this step can include powder coating the midsole 24 or the outsole 26 before joining the midsole 24 to the outsole 26. When bonded together, the midsole 24 and the outsole 26 form a flexible sole element that can flex upwardly for dorsi-flexion and that can flex downwardly for plantar-flexion.

The step of joining the midsole to the insole element or to the upper is depicted as step 118 in FIG. 17. This step generally includes applying adhesive or cement, or otherwise bonding the midsole upper surface 52 to the insole element 22 and/or the upper 12. This step is optionally performed while the insole element 22 and the upper 12 are positioned over a last. The adhesive, cement or other bonding agent is optionally not applied to the portion of the midsole 24 underlying the opening in the insole element 22. Instead, the adhesive, cement or other bonding agent is applied to the rearfoot portion, the arch portion, and the periphery of the forefoot portion of the midsole uppers surface 52.

Figure 18:
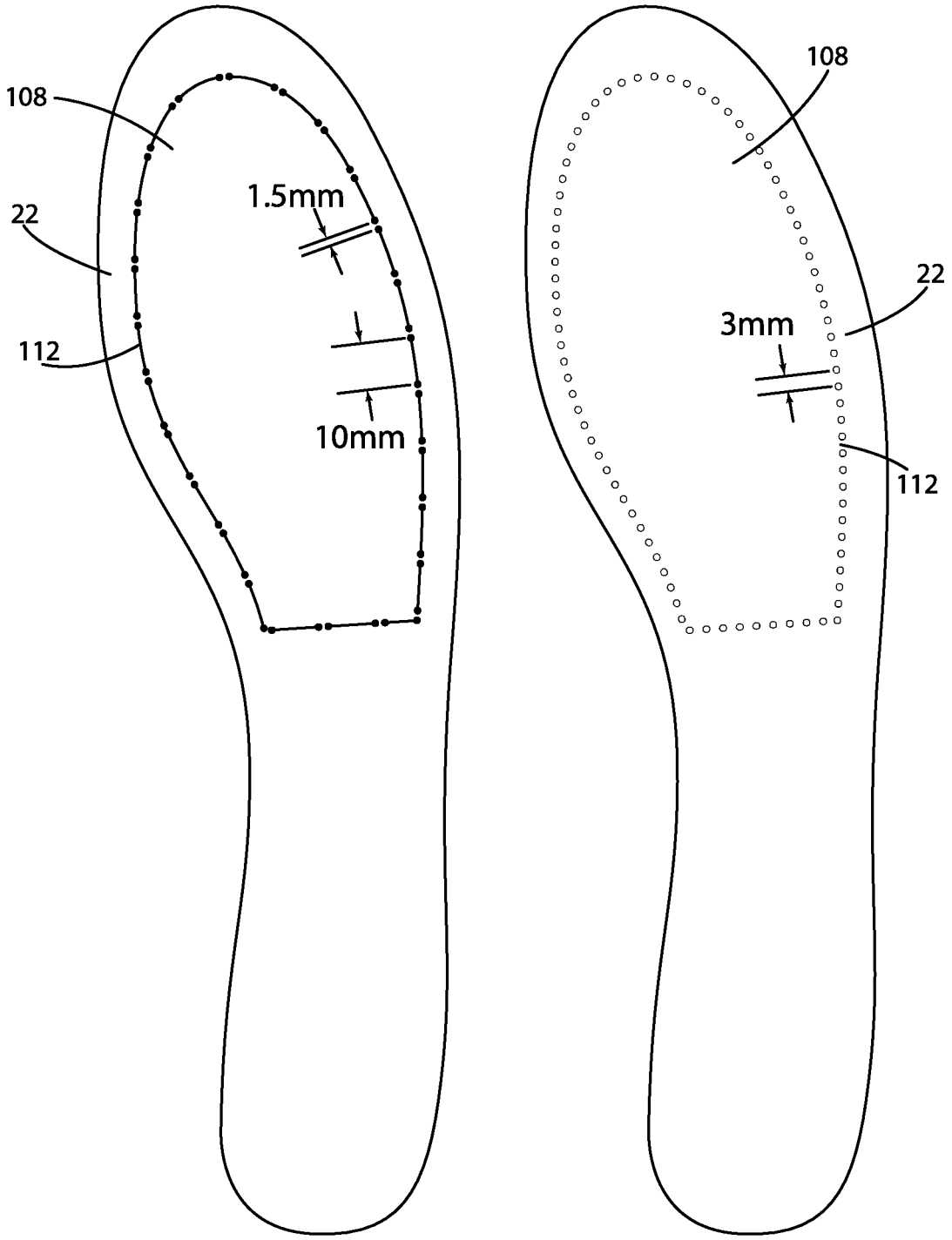
FIG. 18 is a plan view of insole elements including perforations surrounding a removable forefoot portion.
Figure 19:
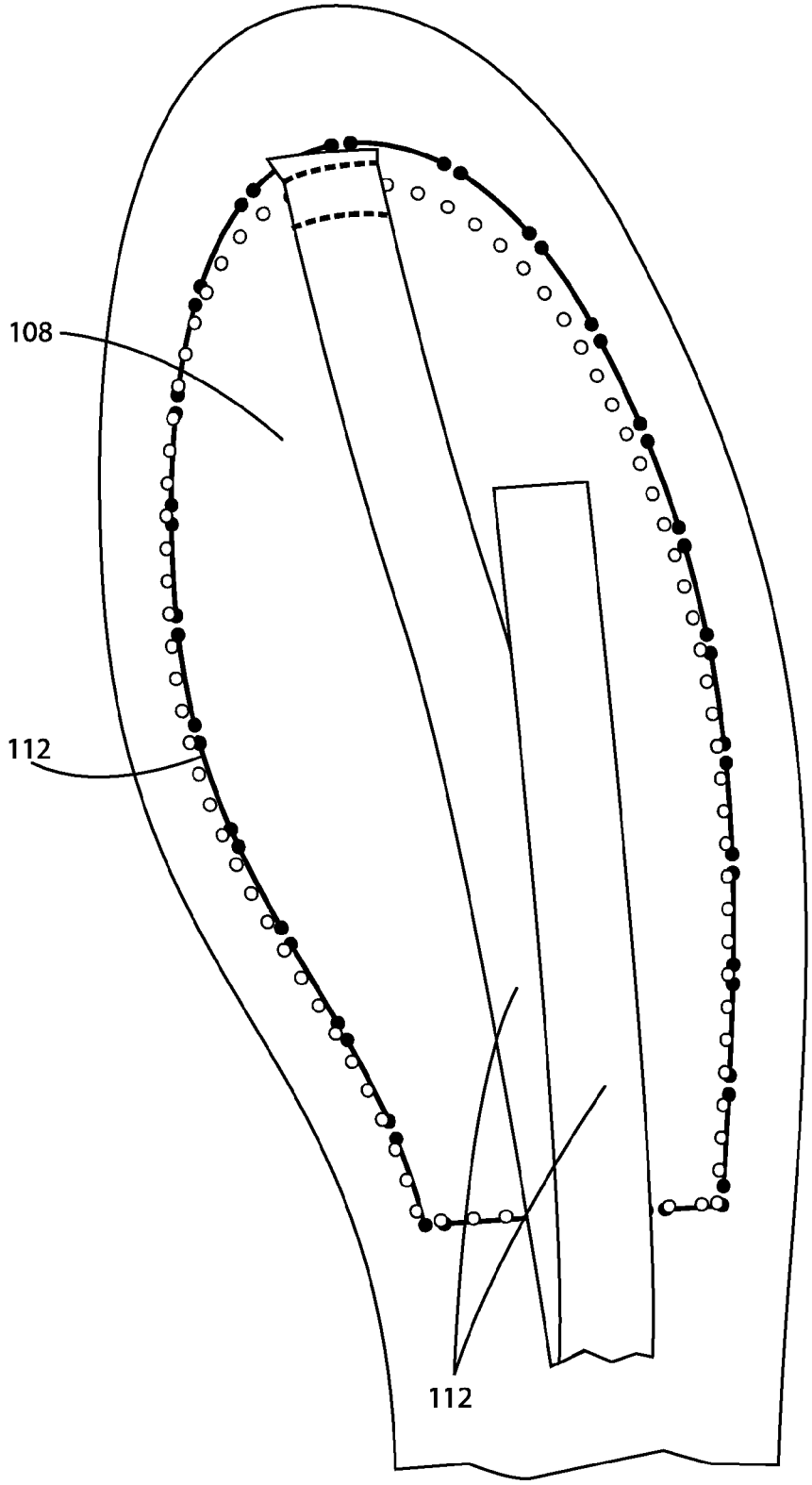
FIG. 19 is a plan view of an insole element including webbing joined to the removable forefoot portion of the insole element.

Separating a removable portion from the insole element is depicted as step 120 in FIG. 17. As shown in FIG. 18, the removable portion 108 is generally interiorly disposed, being spaced apart from the outer periphery of the insole element 22. For example, the removable portion 108 can be surrounded by a peripheral lip 36, which remains attached to the insole element 22. The removable portion 108 is optionally formed by perforating the insole element 22 in advance of the step 110 above. The perforations can include 10 mm slots with 1.5 mm spacing in one embodiment, or 1 mm holes with 1.5 mm spacing in other embodiments. As shown in FIG. 19, the removable portion 108 can include a pull tab or webbing 110 which can be pulled for separating the removable portion 108 from the insole element 22. The webbing 110 can be joined to the removable portion 108 by sewing, gluing, stapling, or otherwise attaching the webbing 110 to the removable portion 108. The attachment between the webbing 110 and the removable portion 108 is generally stronger than the perforation between the removable portion 108 and the remainder of the insole element 22. When the webbing 110 is pulled toward the heel, the removable portion 108 is separated from the remainder of the insole element 22 along the perforation line 112, leaving the opening in the forefoot region of the insole element 22. The webbing 110 is formed from the same material as the insole element 22 in the present embodiment, but can be formed from other materials in other embodiments. The webbing 110 and the removable portion 108 can then be discarded as scrap material or reused as webbing for subsequent insole elements.

Positioning a footbed over the insole elements is depicted as step 122 in FIG. 17. The footbed 106 can include a molded foam element having a size and a shape adapted to support at least a portion of a foot of the wearer of the article of footwear 10. For example, in some embodiments the footbed 106 can generally surround the forefoot of the wearer, the arch of the wearer, and the heel of the wearer. The footbed 106 is a free-floating removable element in some embodiments, while in other embodiments the footbed 106 is bonded to the insole element 22, the midsole 24, or both the insole element 22 and the midsole 24. The footbed 106 can be formed of essentially any lightweight material, including for example foam latex, ethylene-vinyl acetate, thermoplastic elastomer, or polyurethane.

The order and/or inclusion of the above steps can be modified in other embodiments where desired. For example, the step of separating the removable portion from the insole element (step 120) can occur before the step of joining the midsole to the insole element (step 118). Also by example, the step of positioning a footbed 106 in the article of footwear (step 122) can be omitted. Additional steps can also be included. For example, the above method steps can include placing additional cushioning elements in the sole construction, thereby providing additional cushioning to the wearer.

The finished article of footwear generally includes a midsole lower surface is directly or indirectly joined to the outsole upper surface to define a midsole-outsole interface. The interface is functionally a flexible spine about which the sole construction can be flexed. For example, the flexible spine can be flexed upwardly in the forefoot region for dorsi-flexion. Also by example, the flexible spine can be flexed downwardly in the forefoot region for plantar-flexion. The flexible spine can also flex in the rearfoot region of the sole construction and in the arch region of the sole construction. The flexible spine can also accommodate twisting about the longitudinal axis of the sole construction. For example, the forefoot region can twist with respect to the rearfoot region. The sole construction therefore provides flexibility and support, even where flexibility and support are competing objectives in conventional footwear constructions.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to packages of any specific orientation(s). Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The invention claimed is:

1. An article of footwear having an upper and a sole component, the sole component comprising:

a footbed;

an insole element including a forefoot region, the forefoot region defining an open area within an interior portion of the insole element, the footbed being removably positioned over the forefoot region of the insole element;

a midsole including an upper surface and a lower surface defining a midsole thickness therebetween, the midsole upper surface defining a plurality of midsole grooves having a depth through at least a portion of the midsole thickness, the plurality of midsole grooves including four longitudinal grooves extending in a heel-to-toe direction and first and second lateral grooves extending in a direction that is transverse to the heel-to-toe direction, the four longitudinal grooves being spaced apart from each other and configured to be beneath a gap between adjacent toes of a wearer's foot, the first lateral groove intersecting the four longitudinal grooves and being configured to be beneath a junction between toes and metatarsals of the wearer's foot, the second lateral groove intersecting the four longitudinal grooves and being configured to be beneath metatarsals of the wearer's foot; and an outsole including an upper surface and a lower surface defining an outsole thickness therebetween, the outsole lower surface defining a plurality of outsole grooves having a depth through at least a portion of the outsole thickness, wherein the midsole is positioned between the insole element and the outsole, and wherein the open area of the insole element extends over a portion of the plurality of midsole grooves to facilitate plantar-flexion and dorsi-flexion of the sole component, wherein the plurality of midsole grooves cooperate to define a plurality of anatomical pods in the midsole upper surface, at least two of the plurality of anatomical pods being bordered on four sides by the plurality of midsole grooves and being entirely within the open area of the insole element such that the at least two of the anatomical pods are viewable through the open area in the insole element when the footbed is removed from the article of footwear.

2. The article of footwear of claim 1 wherein the depth of the plurality of midsole grooves is between 25% and 95% of the midsole thickness.

3. The article of footwear of claim 1 wherein the depth of the plurality of outsole grooves is between 25% and 95% of the outsole thickness.

4. The article of footwear of claim 1 further including a film interposed between the midsole and the outsole for ground protection and durability.

5. The article of footwear of claim 4 wherein the midsole includes EVA foam and wherein the film includes EVA plastic.

6. An article of footwear having an upper and a sole component, the sole component comprising:

a footbed;

an insole element including a forefoot region, the forefoot region defining an opening extending through the insole element within an interior portion of the insole element, the footbed being removably positioned over the forefoot region of the insole element;

a midsole including a plurality of midsole grooves in an upper surface thereof, the plurality of midsole grooves including four longitudinal grooves extending in a heel-to-toe direction and first and second lateral grooves extending in a direction that is transverse to the heel-to-toe direction, the four longitudinal grooves being spaced apart from each other and configured to be beneath a gap between adjacent toes of a wearer's foot, the first lateral groove intersecting the four longitudinal grooves and being configured to be beneath a junction between toes and metatarsals of the wearer's foot, the second lateral groove intersecting the four longitudinal grooves and being configured to be beneath metatarsals of the wearer's foot, the opening of the insole element extending over a portion of the plurality of midsole grooves; and an outsole including a plurality of outsole grooves in a lower surface thereof that extend around a plurality of tread elements;

wherein the insole element is positioned above the midsole and wherein the midsole is joined to the outsole along an interface, the interface defining a flexible spine about which the sole component is flexible upwardly for dorsi-flexion of a wearer's foot and downwardly for plantar-flexion of a wearer's foot, wherein the plurality of midsole grooves cooperate to define a plurality of anatomical pods in the midsole upper surface, at least two of the plurality of anatomical pods being bordered on four sides by the plurality of midsole grooves and being entirely within the opening in the insole element such that the at least two of the anatomical pods are viewable through the opening in the midsole when the footbed is removed from the article of footwear.

7. The article of footwear of claim 6 wherein the midsole defines a thickness and wherein each of the plurality of midsole grooves includes a depth that is less than the thickness of the midsole, such that the plurality of midsole grooves are not in communication with the outsole.

8. The article of footwear of claim 6 wherein the outsole defines a thickness and wherein each of the plurality of outsole grooves includes a depth that is less than the thickness of the outsole, such that the plurality of outsole grooves are not in communication with the midsole.

9. The article of footwear of claim 6 wherein the midsole includes a sidewall, and wherein the plurality of midsole grooves are contained within the upper surface of the midsole and do not extend through to the midsole sidewall.

10. The article of footwear of claim 6 further including a protective film interposed between the midsole and the outsole.

11. The article of footwear of claim 6 further including an elastic material extending over the opening in the insole element.

12. The article of footwear of claim 6 wherein the midsole is formed from polyurethane foam.

* * * * *